United States Patent [19]

Kürth et al.

[11] 4,007,608

[45] Feb. 15, 1977

[54] CAM SYSTEMS FOR CIRCULAR KNITTING MACHINES

[75] Inventors: Harald Kürth, Mittweida; Dieter Laübe, Frankenau; Erich Berthold, Mittweida, all of Germany

[73] Assignee: VEB Wirkmaschinenbau Karl-Marx-Stadt, Karl-Marx-Stadt, Germany

[22] Filed: Aug. 7, 1975

[21] Appl. No.: 602,607

Related U.S. Application Data

[62] Division of Ser. No. 298,163, Oct. 16, 1972, Pat. No. 3,926,013.

[52] U.S. Cl. ..... 66/40; 66/57

[51] Int. Cl.[2] ..... D04B 9/00

[58] Field of Search ..... 66/57, 40, 50 R, 25, 66/78

[56] References Cited

UNITED STATES PATENTS

| | | | |
|---|---|---|---|
| 3,030,785 | 4/1962 | Lunak | 66/57 |
| 3,490,252 | 1/1970 | Paepke et al. | 66/57 |
| 3,670,526 | 6/1972 | Martinetz | 66/57 |
| 3,696,641 | 10/1972 | Sumitomo | 66/57 X |
| 3,795,119 | 3/1974 | Bourgeois | 66/57 X |

FOREIGN PATENTS OR APPLICATIONS

| | | | |
|---|---|---|---|
| 193,531 | 11/1957 | Austria | 66/78 |
| 527,645 | 7/1956 | Canada | 66/57 |

*Primary Examiner*—Mervin Stein
*Assistant Examiner*—Andrew M. Falik
*Attorney, Agent, or Firm*—Nolte and Nolte

[57] ABSTRACT

A cam system for a circular knitting machine includes a cam retainer having an aperture for receiving a cam carrier, so that the cam carrier may be held in the retainer in a fixed position. The cam carrier may be fixed in the cam retainer at a number of predetermined positions, and the cam carrier has affixed thereto at least two cam surfaces which may be selectively positioned in opposite relationship in the knitting machine.

5 Claims, 7 Drawing Figures

CAM SYSTEMS FOR CIRCULAR KNITTING MACHINES

This application is divided from application Ser. No. 298,163 filed Oct. 16, 1972 and now issued as U.S. Pat. No. 3,926,013.

BACKGROUND OF THE INVENTION

This invention relates to cam systems for knitting machines, and is particularly directed to the provision of an improved arrangement permitting the changing of the position of cam surfaces as well as interchanging cams in a cam retainer of circular knitting machines.

In one arrangement enabling the rapid attachment of a cam carrier on a cam retainer, or a cam retainer on its cam carrier, bayonet joints are employed to permit the ready replacement of cam surfaces. Such a system is shown, for example, in German Offenlegungschriften No. 1,938,891 published Oct. 15, 1970. In this arrangement, the cam retainers must be removed in order to enable the exchange or replacement of the cam carrier having the cam surface. While it is possible to preassemble the cam carrier having the cam surface on the cam retainer, this expedient necessitates the provision of a large stock of cam retainers and cam carriers, and as a consequence a considerable period of time is required for the supporting and locating of the desired elements.

U.S. Pat. No. 3,490,252 also discloses a cam system having a cam surface secured to a cam carrier. In this arrangement having the cam surface is exchanged or replaced externally by pulling the cam retainer from a bore. The locking of the cam carrier is effected by the use of a spring lock stopping system. This arrangement also has the disadvantage that it is necessary to maintain a large supply of cam carriers having different cam surfaces. Consequently, the arrangement necessitates the expenditure of considerable time to maintain the stock of cam carriers. In order to insure the rapid exchange or replacement of the carriers having different lock surfaces, it is thus necessary to employ costly techniques. In addition, the manufacture of the cam system of such an arrangement is very costly.

It is therefore the object of this invention to provide a cam system especially adapted for large circular knitting machines, that overcomes the above problems of previous cam systems, and that eliminates the time required for the sorting, locating and preparing of the system for the exchange or replacement of the cam carrier, as well as to reduce the necessity for a large stock of replacable elements and to reduce the unit costs of the elements employed.

The invention is directed to the provision of a cam system for circular knitting machines which employs easily fabricated elements as well as an economic arrangement of the cam system.

SUMMARY OF THE INVENTION

Briefly stated, in accordance with the invention, a cam carrier is provided, for use in a circular knitting machine, the cam carrier having or carrying at least two cam surfaces.

In one embodiment of the invention, the cam carrier consists of a cylindrical support having a recess. A plate having a plurality of cam surfaces is secured in the recess of the support, the cam surfaces either being formed of separate elements or formed integrally with the plate.

In a further embodiment of the invention, the cam carrier is comprised of a cylindrical support having a bore, a bolt being provided in the cylindrical support and having a threaded lug for selective engagement with threaded bores on a cube shaped member having a plurality of cam surfaces.

In accordance with a further embodiment of the invention, the cam carrier is comprised of a cylindrical cam support member having a stop collar for holding the support in cam retainers, with different cam surfaces being provided on the ends of the cylindrical support member.

The invention provides a cam system which enables the elimination of the preparation time involved in the exchange or replacement of the cam carrier, by employing a cam carrier having several cam surfaces. As a result of the use of easily fabricated elements and an expedient arrangement of the elements, the required maintenance of the stock of such elements is minimized. In addition, the arrangement enables the rapid and simple changing of the cam surfaces for different cam positions, and the simple exchange or replacement of the cam carrier, as well as the cost saving manufacture of the cam system.

Brief Description of the Drawings

In order that the invention will be more clearly understood, it will now be described in greater detail with reference to the accompanying drawings, in which.

Description of the Preferred Embodiments

Figure 1:
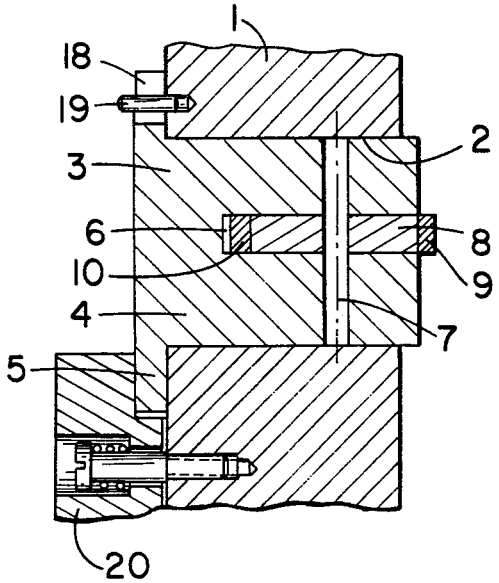
FIG. 1 is a longitudinal cross-sectional view of one embodiment of a cam system in accordance with the invention.
Figure 2:
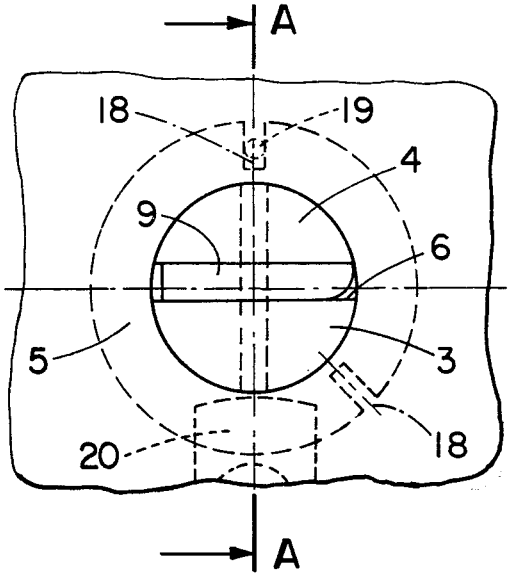
FIG. 2 is a side elevation of the arrangement of FIG. 1.

Referring now to the drawings, and more in particular to FIGS. 1 and 2, a cam retainer 1 for use in a conventional circular knitting machine is provided with a transversely extending bore 2, and a cam carrier, indicated generally by the numeral 3, is provided in the bore 2. The carrier 3 is comprised of a cylindrical support member 4 positioned coaxially within the bore 2. One end of the support 4 is provided with a stop collar 5, for example an enlarged diameter end portion of the support 4, which engages one surface of the retainer 1 to limit the movement of the support 4 in one direction. The support 4 is locked in position in the radial direction in the bore 2 by means of a locking lever 20, the locking lever 20 for example being mounted for rotation on the surface of the retainer 1 by means of a bolt extending into and threaded in the retainer 1, with a spring being provided between the head of the bolt and a shoulder in the lever 20 to permit the rotation of the lever 20. The lever 20 has a projection which engages the stop collar 5 in the locked position for holding the support 4 within the bore 2.

A transversely extending recess 6 is provided in the cylindrical support 4 in the end thereof away from the stop collar, and a plate 8 is mounted in the recess 6 for rotation therein by means of a pin 7 extending transversely of the axis of the cylindrical support 4 and normal to the plate 8. Two opposed edges of the plate 8 are provided with cam surfaces 9 and 10 respectively, which may be in the form of separate elements affixed to the plate 8, or they may be formed integrally with the plate 8. The plate is positioned so that one of the cam surfaces 9 and 10 projects beyond the end of the cylindrical support 4, and the plate 8 is restrained from rotation about the pin 7 when the support 4 is in the bore 2. The other of the cam surfaces 9 and 10 may be moved to operative position by releasing the locking lever 20 by rotation thereof, removing of the support 4 from the bore 2, rotating the plate 8 about the pin 7 through an angle of 180°, and then reinserting the support 4 in the bore and locking it in place with the locking lever 20. The sides of the bore 2 restrain the plate 8 from rotation when the support 4 is in position within the bore.

The stop collar 5 is provided with one or more recesses 18 about its perimeter (two recesses 18 being illustrated in FIG. 2) and a pin 19 is held in the carrier 1 aligned with one of the recesses 18 to prevent rotation of the support 4 and to permit alignment of the cam surfaces at predetermined positions. Thus, in the arrangement illustrated in FIG. 2, the support 4 may be selectively positioned in the bore with either of the two recesses 18 aligned with the pin 19, thereby providing two possible alignments of the cam surface.

Figure 3:
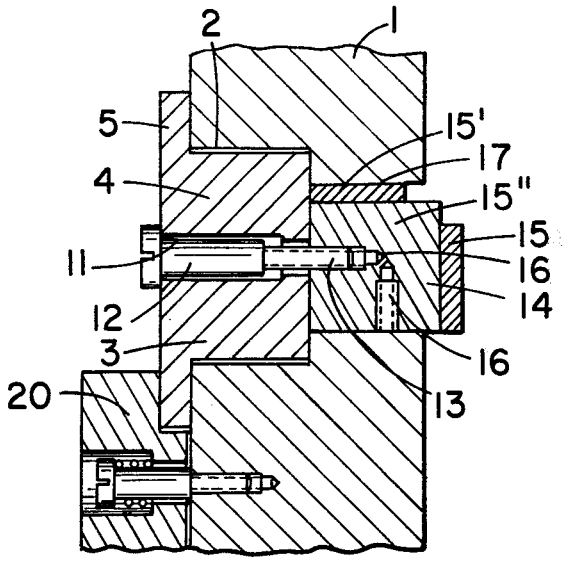
FIG. 3 is a longitudinal cross-sectional view of a cam system in accordance with another embodiment of the invention.

In the arrangement of FIG. 3, a bore 2 is provided extending only part way through the cam retainer 1, and a recess 17 of square cross-section is aligned with the bore 2 and extends the remainder of the way through the cam retainer 1. A cylindrical cam support 4 is assembled in the bore 2, the support 4 having a stop ring 5 similar to the stop ring 5 of FIG. 1. The arrangement of FIG. 3 is also provided with a locking lever 20 as in the arrangement of FIG. 1. The support 4 is provided with a central axially extending bore 11, and a bolt 12 extending through the bore 11 is threaded into a threaded aperture 16 of a cube 14, the bolt having threads 13. The cube 14 is positioned in the recess 17. The enlarged head of the bolt 12 thus holds the cube 14 in position against the support 4. At least two edges of the cube 14 are provided with cam surfaces, such as surfaces 15 and 15', the cube 14 being provided with a plurality of the threaded apertures 16 so that the cam surfaces may be selectively operatively positioned. Thus, while only two cams surfaces are illustrated in FIG. 3, it will be apparent that more such surfaces may be provided on the cube, with corresponding threaded apertures, so that any of the cam surfaces may be employed. In the arrangement of FIG. 3 it is apparent that no additional means are required to prevent rotation of the support 4, since the cube 14 and the nonselected cam surfaces are positioned within the square recess. Further as in the arrangement of FIGS. 1 and 2, the cam surfaces may be either formed as separate elements, or may be integrally formed with the cube 14.

The operative cam surface in the arrangement of FIG. 3 may be thus changed by the removal of the support 4 upon release of the locking lever 20, and the reattachment of the cube 14 to support 4 by means of the bolt 12 to align the selected cam surface to operative positions. If the angular position of a selected cam surface is to be changed, this can of course be accomplished by removing of the support 4 and rotating it through 90 or 180° as desired, followed by reinsertion of the assembly in the cam retainer 1.

Figure 4:
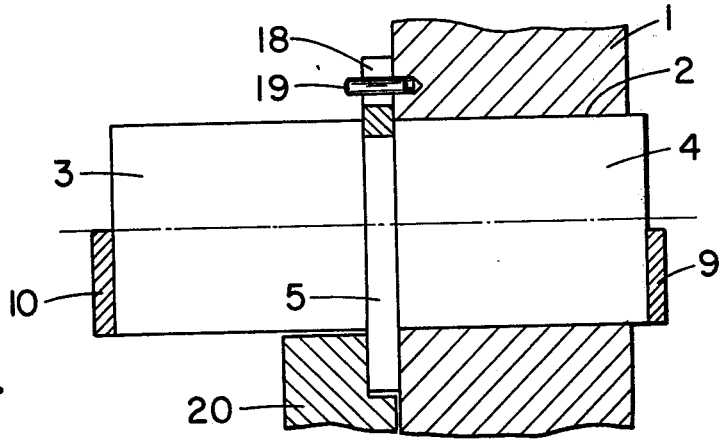
FIG. 4 is a longitudinal partially cross-sectional view of still another embodiment of a cam carrier system in accordance with the invention.

In a further modification of the invention as illustrated in FIG. 4, the cam retainer 1 is provided with a bore 2 as in the arrangement of FIG. 1, although in this arrangement the exchangable carrier 3 is comprised of a cylindrical support 4 having a cam surface 9 at one end and a cam surface 10 at the other end. In this arrangement, the support 4 is provided with a stop collar 5 centrally disposed on the support 4, and similar to the support 5 of the embodiment of FIGS. 1 and 2. Further, as in the arrangement of FIGS. 1 and 2, one or more recesses 18 are provided in the stop collar, alignable with a pin 19 in the cam retainer 1, to permit positioning of the support 4 at different angular displacements. In the arrangement of FIG. 4 the angle of a selected cam surface is thus accomplished by release of the lock lever and removal of the support 4 to permit alignment of the pin 19 with a different recess 18, while exchange of the cam surface is accomplished by removal of the support 4 and reinsertion thereof in the reversed sense.

Figure 5:
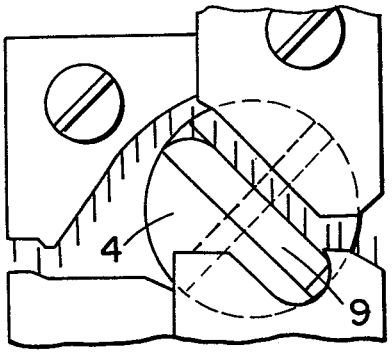
FIGS. 5 – 7 are views of cam surfaces, for example employing the arrangement of FIG. 1 in combination with needle guiding structures, in the ejected, catching and rotating position respectively.
Figure 6:
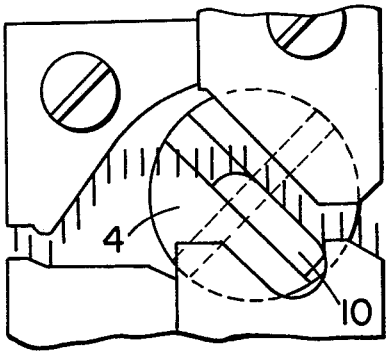
Figure 7:
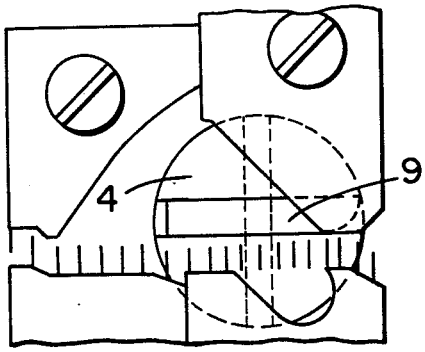

FIGS. 5–7 illustrate the arrangement of FIGS. 1 and 2 in three different positions, i.e. ejecting, tucking and circular running positions, in combination with a needle guiding structure employed in a circular knitting machine. Thus, in the ejection position illustrated in FIG. 5 the cam surface 14 is in operative position with one angular displacement, and in the rotation position of FIG. 7 the same cam surface 14 is in operative position, although with a different angular displacement, achieved by alignment of another of the recesses 18 with the pin 19. In the catching position illustrated in FIG. 6, the plate 12 has been rotated so that the outer cam surface 15 is in operative position.

In FIGS. 5–7, the series of short vertical lines extending across the illustrations and around the cam surfaces shows the track of the needle butts during operation of the knitting machine employing the cam system of the invention, and additional cam surfaces mounted in the knitting machine, are also illustrated in front of the cam retainer and support, for guiding the needle butts in conjunction with the cam 10.

While the invention has been disclosed and described with reference to a limited number of embodiments, it is apparent that many modifications and variations may be made therein without departing from the invention, and it is therefore intended in the following claims to cover each such modification and variation as falls within the true spirit and scope of the invention.

What is claimed is:

1. A cam system for a circular knitting machine comprising a cam retainer, cam carrier means, at least two cam surfaces on said cam carrier means, means releasably mounting said cam carrier means in said cam retainer in a selected one of at least two positions in which a selected one of said cam surfaces is disposed in an operative position and the others of said cam surfaces are in inoperative positions, and means holding said selected one cam surface in a selected one of a plurality of angular attitudes relative to said retainer wherein said cam carrier means comprises a cylindrical support having a central bore, a cube shaped element having cam surfaces on at least two faces thereof, and bolt means extending through said bore for selectively holding said cube shaped element on said cylindrical support to dispose a selected one of said cam surfaces in an operative position.

2. A cam system as claimed in claim 1 wherein angularly spaced abutment faces are disposed on said cylindrical support and said retainer has an angularly fixed, releasable stop means cooperating with a selected one of said abutment faces, said abutment faces and stop means constituting said means holding said selected one cam in a selected one of a plurality of angular attitudes relative to said retainer.

3. A cam system as claimed in claim 1, wherein said cylindrical support includes an annular stop collar including abutment faces defined by angularly spaced notch means in the periphery of said stop collar, said retainer having an angularly fixed, releasable stop means cooperating with a selected one of said notch means to hold a cam face in a selected attitude.

4. A cam system for a circular knitting machine comprising a cam retainer, cam carrier means, at least two cam surfaces on said cam carrier means, means releasably mounting said cam carrier in said cam retainer in a selected one of at least two positions in which a selected one of said cam surfaces is disposed in an operative position and the others of said cam surfaces are in inoperative positions, and means holding said selected one cam surface in a selected one of a plurality of angular attitudes relative to said retainer wherein said cam carrier means comprises a cylindrical support having cam surfaces at opposite ends thereof, and said means for holding said carrier means in said cam retainer comprising a stop collar on said cylindrical support.

5. A cam system for a circular knitting machine comprising a cam retainer, cam carrier means movably mounted on said retainer, cooperating means on said retainer and cam carrier means effective to releasably secure said carrier means in a selected one of at least two positions relative to said container, a cam element having at least two cam surfaces, said cam element being mounted on said carrier means, cooperating means on said carrier means and said cam element effective to releasably secure said element in a selected one of at least two positions relative to said carrier in each of said positions of said element relative to said carrier only one of the cam surfaces being in an operative position and the others being in inoperative positions.

* * * * *